United States Patent [19]

Ferris et al.

[11] 4,248,009

[45] Feb. 3, 1981

[54] TOY MOTOR VEHICLE

[75] Inventors: Michael J. Ferris, Chicago; Burton C. Meyer, Downers Grove; Alan A. Hicks; Henry Arias, both of Chicago, all of Ill.

[73] Assignee: Marvin Glass & Associates, Chicago, Ill.

[21] Appl. No.: 116,929

[22] Filed: Jan. 30, 1980

[51] Int. Cl.[3] ..... A63H 11/10

[52] U.S. Cl. ..... 46/202; 46/204

[58] Field of Search ..... 46/202, 204, 201, 205, 46/43, 206, 219, 221, 40

[56] References Cited

U.S. PATENT DOCUMENTS

| | | | |
|---|---|---|---|
| 1,911,600 | 5/1933 | Bobertz, Jr. et al. | 46/201 |
| 3,191,343 | 6/1965 | Goldfarb | 46/204 X |
| 3,523,385 | 8/1970 | Noble | 46/205 X |
| 3,707,805 | 1/1973 | Buck | 46/202 |
| 4,198,068 | 4/1980 | Goldfarb et al. | 46/204 X |

OTHER PUBLICATIONS

"Juggling Jumbo", Fisher & Price Toys, *Playthings*, vol. 56–No. 6, p. 8 Jun. 1958.

*Primary Examiner*—Robert Peshock
*Assistant Examiner*—Mickey Yu
*Attorney, Agent, or Firm*—Mason, Kolehmainen, Rathburn & Wyss

[57] ABSTRACT

A toy motor vehicle includes a body supported by wheels for rolling movement over a supporting surface. The body is provided with a first compartment having a transparent wall segment and a second compartment in communication therewith having opaque walls. A plurality of balls representing gallons of fuel are adapted to be contained in the respective compartments and means is provided for moving the balls from the first compartment into the second compartment as the toy vehicle is moved around, thus simulating the using up and eventually running out of gas when all the balls are moved out of view into the second, opaque-walled compartment. A gas pump element is detachably connectable with the vehicle and includes a rotating flexible shaft which is adapted to drive a mechanism in the vehicle for returning the fuel elements or balls from the opaque compartment back into the first compartment to simulate refueling of the vehicle at a gas pump. Each time a ball is returned into the first compartment a bell is rung to simulate the action of a gas pump.

14 Claims, 5 Drawing Figures

TOY MOTOR VEHICLE

BACKGROUND OF THE INVENTION

1. Field of the Invention

The present invention relates to toy vehicles and more particularly to a toy motor vehicle adapted to be used in combination with an element representing a gas pump which is detachably connectable with the toy vehicle to simulate the refueling thereof.

2. Description of the Prior Art

A wide variety of toy motor vehicles have been developed for use at play by young children and the like. Many of these toy motor vehicles provide animated action that simulates real life occurences such as flat tires, running out of gas, break downs and the like. As far as is known, however, a toy motor vehicle has not been provided having a pair of compartments in communication with each other and adapted to receive and contain fuel elements such as balls or the like movable back and forth between the compartments during play to simulate both a condition of running out of fuel and subsequent refilling with fuel.

More particularly, no one has provided a toy motor vehicle of this character in combination with an external, detachably connectable gas pump that is manually operated to simulate a gas pump refueling the vehicle by moving the fuel elements out of an opaque-walled compartment within the vehicle into a separate compartment therein having a transparent wall section wherein the balls are readily visible. Operation of the pump simulates the action of refueling the vehicle and subsequently, as the vehicle is moved around, the fuel elements are returned into the opaque compartment simulating the using up of fuel and eventually running out of gas when all of the fuel elements are gone from the visible compartment.

OBJECTS OF THE PRESENT INVENTION

It is an object of the present invention to provide a new and improved toy motor vehicle of the character described.

More particularly, it is an object of the present invention to provide a new and improved toy motor vehicle of the character described adapted for use in combination with a detachably connectable external element which resembles a gas pump and which is operated manually to simulate refueling of the vehicle.

Yet another object of the present invention is to provide a new and improved toy motor vehicle having a pair of internal, interconnected compartments, one of which has transparent walls and the other having opaque walls and wherein fuel elements in the form of balls or other discrete objects are displaced back and forth between the compartments in simulation of using up and running out of fuel as the vehicle is moved around and subsequently refueling the vehicle at the gas pump.

It is another object of the present invention to provide a new and improved toy motor vehicle and/or vehicle gas pump combination of the character described which is neat in appearance, fun to play with and which is economically constructed and especially well adapted for play by young children and the like.

SUMMARY OF THE INVENTION

The foregoing and other objects and advantages of the present invention are accomplished in a new and improved toy motor vehicle of the character which includes a body supported by wheels for movement over a surface such as a floor, rug or the like. The body is formed with first and second internal compartments in communication with each other and the first compartment includes a wall portion of transparent material so that elements such as balls or spheres designated to represent gallons of fuel may be readily viewed from the exterior of the vehicle. The vehicle is provided with means for moving the elements upon rolling of the vehicle from the first compartment one at a time into the second compartment which has opaque walls and this action simulates the burning of fuel and eventually running out of gas when all the balls are out of view. A manually operated external gas pump mechanism is detachably connectable with the toy motor vehicle and this element resembles a fuel or gas pump and includes manually operated, rotatable flexible shaft which is connectable with the toy vehicle and is adapted to operate an internal mechanism therein for returning the fuel elements from the opaque-walled compartment back into the first compartment wherein the fuel elements are again visible thus simulating the filling up of the vehicle with fuel. As the toy vehicle is being refueled, a sound generator which may take the form of a bell is activated resembling the sound of an operating gas pump at a gas station.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
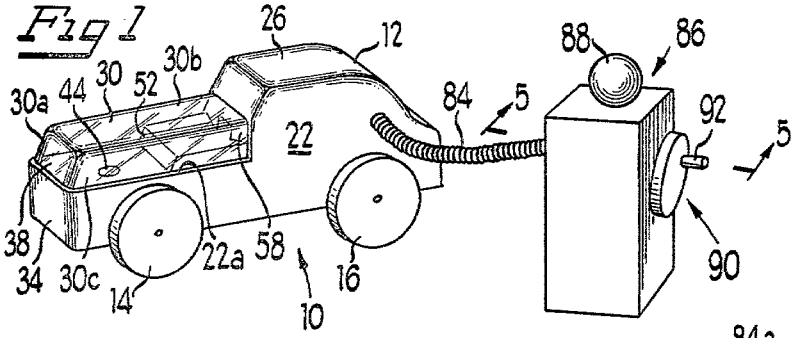
FIG. 1 is a perspective view of a new and improved toy motor vehicle and gas pump combination constructed in accordance with the features of the present invention and shown with the motor vehicle in position with a flexible shaft of the gas pump attached for simulating the refueling of the vehicle.

Referring now more particularly to the drawings, therein is illustrated a new and improved toy motor vehicle or auto constructed in accordance with the features of the present invention and referred to generally by the reference numeral 10. The vehicle 10 includes a hollow body 12 preferably formed of thin, molded plastic material and supported for rolling movement by a pair of front wheels 14 and a pair of rear wheels 16 carried on respective, transversely extending, front and rear axles 18 and 20.

Figure 4:
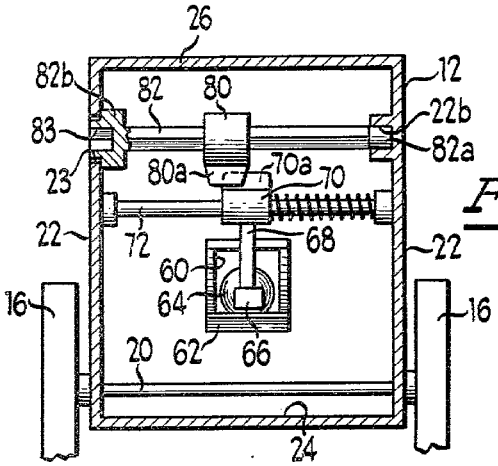
FIG. 4 is a vertically extending, transverse, cross-sectional view taken substantially along lines 4—4 of FIG 2.
Figure 2:
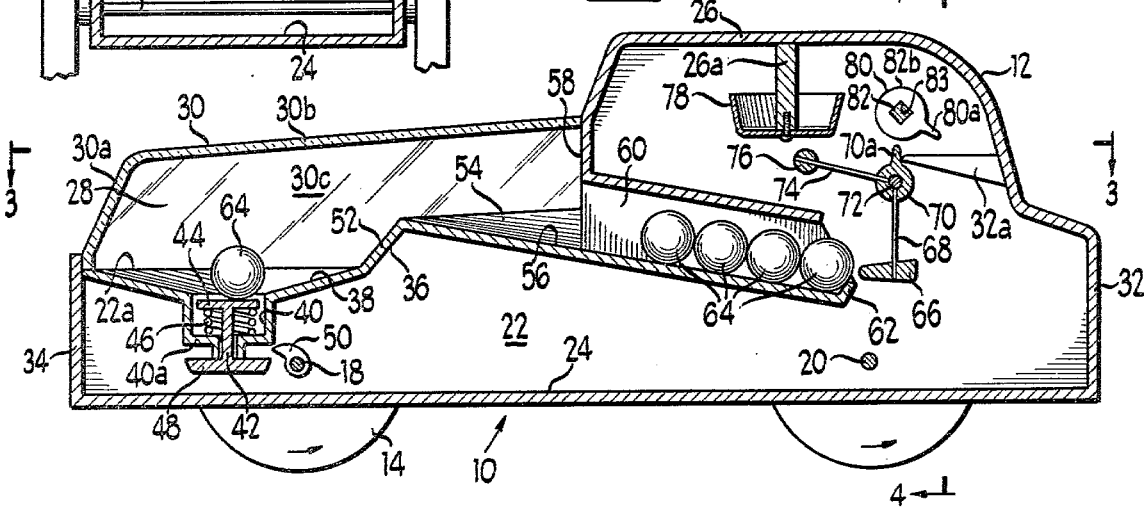
FIG. 2 is a longitudinally extending, vertical, cross-sectional view of the toy vehicle of FIG. 1.

As best shown in FIGS. 2 and 4, the front and rear axles 18 and 20 extend through the hollow body and opposite sidewalls 22 thereof at a level spaced above a lower or bottom wall 24. Forward movement of the vehicle 10 on a supporting surface causes the wheels 14 and 16 to turn in a counterclockwise direction as indicated in FIG. 2 and when this occurs, the supporting axles 18 and 20 are rotated in the same direction .

The hollow body 12 includes a contoured top wall segment 26 at the rear portion or passenger compartment thereof and at the forward end of the body, there is provided a hood or engine compartment 28 having an interior that is visible exteriorly of the vehicle by virtue of an upper wall member 30 formed of thin transparent, sheet plastic material, generally in the shape of an automotive hood. The hollow body 12 of the vehicle also includes a rear end wall 32 and a front end wall or grill 34 having an upper edge portion adjacent a lower edge of a front wall segment 30*a* of the hood 30. The hood also includes a top wall 30*b* and a pair of opposite, integral sidewalls 30*c* which have linear lower edges adjacent inside upper edges 22*a* on the forward end portion of the body sidewalls 22.

Figure 3:
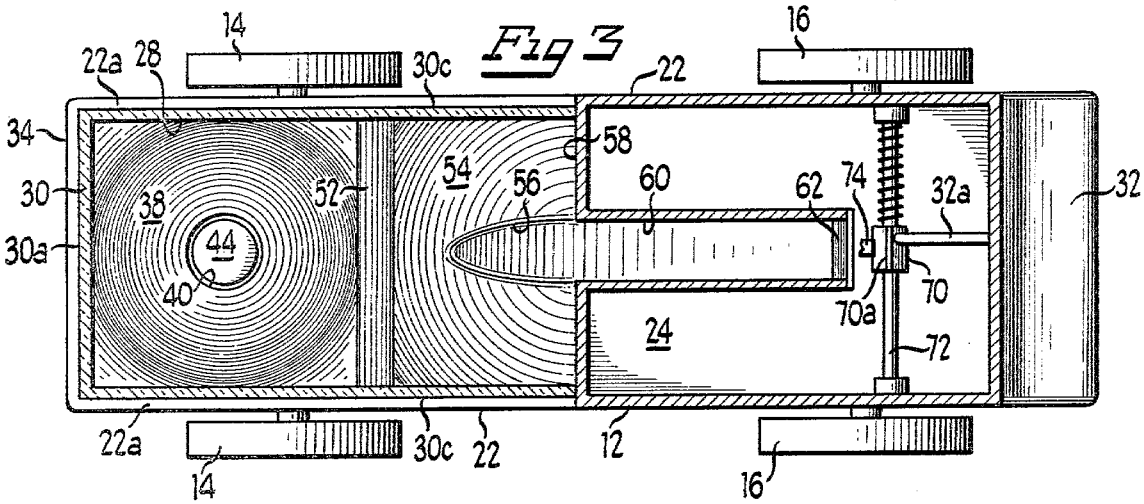
FIG. 3 is a longitudinally extending, horizontal, cross-sectional view taken substantially along lines 3—3 of FIG. 2.

The hood or engine compartment 28 is formed with a bottom wall 36 extending between opposite inside surfaces of the body sidewalls 22 and an inside edge of the front wall 34. The hood compartment bottom wall 36 includes a forward portion 38 of generally frustoconical shape having a downwardly, extending cylindrically shaped cup-like receptacle 40 at the central portion thereof as shown in FIGS. 2 and 3. The cup-like portion 40 includes a cylindrical sidewall and a bottom wall 40*a* having a central aperture formed therein to accommodate the stem 42 of a piston element having a piston-like disc 44 at the upper end of the stem and biased upwardly away from the bottom wall 40*a* by a coaxially disposed bias spring 46.

At the lower end of the stem there is provided a circular disc-like element 48, the upper surface of which is periodically engaged by a rotating cam element 50 carried on the front wheel axle 18. Each time the front wheel 14 of the vehicle completes a revolution as the vehicle is moved, the cam 50 momentarily depresses the disc 48 downwardly to compress the bias spring 46 and as the cam moves out of engagement therewith, the bias spring is then effective to move the stem and piston 44 rapidly upwardly until the upper surface of the disc 48 is stopped by engagement against the lower edge of the bottom wall 40*a* around the central aperture thereof.

The bottom wall 36 of the hood compartment includes an upwardly and rearwardly sloping intermediate wall segment 52 and a downwardly and rearwardly sloping rear segment 54 having a central depression or trough 56 in communication at the rearward end with an opening formed in a vertical intermediate wall segment 58 of the hollow body 12. The central opening in the wall 58 is in communication with the forward end of a hollow, elongated, tubular interior compartment 60 of generally rectangular, transverse cross-section and including a bottom wall portion which slopes downwardly and rearwardly of the trough 56 in the bottom wall of the hood or engine compartment 28. At the rearward end, the interior compartment 60 is formed with an upstanding, transverse stop wall 62 but is otherwise open above the upper edge of the stop wall.

In accordance with the present invention, the forward, hood or engine compartment 28 and the rearward interior compartment 60 are adapted to contain and hold a plurality of spherical elements or balls 64 which may be of various colors and which are preferably formed of light-weight foam or plastic material. Each ball is adapted to represent a quantity of fuel such as a gallon or liter to be used in the vehicle. Any balls that are present in the hood or engine compartment 28 and are forwardly of the sloping intermediate wall 52 will collect on the funnel-shaped, front portion 38 of the bottom wall. These balls will roll onto or toward the upper surface piston element 44 at the center of the wall 38. Any balls that are present in the engine or hood compartment, but rearwardly of the intermediate wall 52 will tend to roll rearwardly and toward the wall 58 and the central trough 56. Once a ball is in the central depression, it will roll through the central opening in the wall 58 and move into the interior of the tubular compartment 60. In this compartment the balls align themselves in a string or row of balls as illustrated in FIG. 2.

The walls of the rearward compartment 60 are formed of opaque material so that the balls present in the compartment are not visible from the exterior of the vehicle. The compartment is large enough to contain all of the balls 64 in the set with the balls aligned in a single string or row as shown. When all of the balls are present in the interior compartment 60, they are almost completely hidden from view from the exterior of the vehicle because substantially all of the wall portions of the hollow body 12 of the vehicle except for the transparent hood 30 are formed of opaque or non-transparent plastic material. The balls contained in the forward, hood or engine compartment 28, however, are clearly visible and when in the forward compartment, these balls represent available fuel to be used.

As the toy vehicle 10 is moved over a surface during play, the rolling front wheels, axle and the rotating cam 50 and spring 46 causes the piston-like disc 44 to move up and down and project or pop-up the balls 64 towards the top wall 30*b* of the transparent hood 30. As this action occurs, the balls will be rebounded downwardly and eventually will move rearwardly to land on the rearward portion of the compartment bottom wall. Once on the rear wall bottom wall, the balls will roll back into the interior compartment 60. Eventually, all of the balls will be accumulated in the rearward compartment 60 as the vehicle is moved about during play. When this condition occurs, the "out of gas" or "low on fuel" condition is simulated because all or most of the balls 64 which represent gallons or liters of fuel are substantially hidden from view in the interior compartment 60.

In accordance with the present invention, the toy motor vehicle 10 may be then refueled by ejecting the balls 64 out from the interior compartment 60 back into the forward engine or hood compartment 28. This is done to simulate "filling up" the tank of the car or "refueling" the car with the vehicle in a stationary position. Ejection of the balls from the compartment 60 is accomplished by a hammer 66 mounted on the outer end of a spring-like arm 68 which extends radially outward of a cylindrical sleeve 70 carried on an axle 72. The axle or shaft 72 extends transversely across the body 12 between the side walls 22 at an elevation above the rear axle 20. The sleeve 70 also supports another radially outwardly extending spring arm 74 which carries a bell clapper 76 at the outer end adapted to strike against and ring a bell 78 which is mounted on the lower end of a stem 26*a* depending downwardly from the inside surface of the top wall 26 of the vehicle body.

The sleeve 70 also includes a radial stop element 70*a* extending in an upward direction diametrically opposite of the spring arm 68 as shown in FIG. 2. The stop element is engageable with a fixed stop element 32*a* on the rear end wall of the vehicle body and this engagement limits the clockwise rotation of the sleeve and shaft beyond the position of FIG. 2. The stop element 70a serves as an activating arm on the sleeve adapted to be momentarily engaged by a trigger element 80a extending radially outwardly on a sleeve element 80. The sleeve 80 is carried on a shaft 82 of square-shaped, transverse cross-section as shown in FIG. 2 and the shaft is spaced above and parallel of the hammer shaft 72. The shaft 82 is formed with a cylindrical end portion 82a journaled in a bearing boss 22b formed on the inside surface of one body sidewall 22 as shown in FIG. 4 and at the opposite end, the shaft is formed with a socket portion 82b having a cylindrical outer segment which is journaled in a circular aperture 23 formed in the opposite body sidewall 22. The socket end portion includes a socket 83 of square-shaped, transverse cross-section which is adapted to detachably receive the outer end portion 84a of a rotatable, elongated, flexible shaft 84. The shaft represents and simulates a pump or filling hose of a gas pump structure 86 which is shaped to represent a common service station type gas pump. The gas pump includes a generally rectangular, hollow, upstanding housing formed of thin molded plastic material and is provided with a spherical ball 88 on the upper or top wall which represents a ball-like, gas bowl on the upper end of a gas pump.

Figure 5:
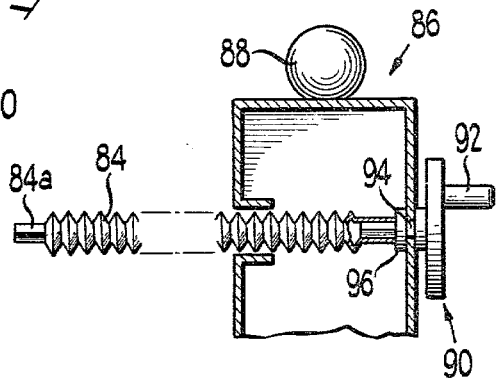
FIG. 5 is a fragmentary, vertical, cross-sectional view taken substantially along lines 5—5 of FIG. 1.

On one wall of the gas pump housing is mounted a manually rotatable crank 90 having an eccentric handle 92 and an axle portion 94 which is journaled in an aperture provided in one sidewall of the pump housing as shown in FIG. 5. A retainer 96 is seated on the axle of the crank to hold the crank in place on the pump housing wall. The axle 94 is connected to an inner end portion of the rotatable, flexible shaft 84 and the flexible shaft extends outwardly through a flanged opening or aperture provided in an opposite sidewall of the gas pump housing.

The outer end portion 84a of the flexible shaft 84 is free to rotate whenever the crank handle 92 is manually rotated and the flatted, end portion of the flexible shaft represents a gas nozzle which is adapted to be detachably connected with the recess or socket 83 of similar transverse cross-section that is provided in the socket end portion 82b of the square cross-sectioned shaft 82 of the vehicle.

Rotation of the crank element 90 in a clockwise direction while the flexible shaft simulating a gas pump hose is connected to the shaft 82 of the vehicle 10, causes the sleeve element 80a to rotate and strike the arm 70a on the hammer supporting sleeve 70. Each time the element 80a moves into and out of engagement with the arm 70a, the hammer 66 is pivoted in a counter-clockwise direction from the vertical position shown in FIG. 2 to move away from the lowest ball 64 at the end wall 62 of the internal compartment 60. After the engagement is broken, the hammer is released to swing in a clockwise direction and strike the lowermost ball 64 while at the same time, the clapper 76 strikes the bell 78 to produce a ringing sound. When this occurs, the uppermost ball or fuel element 64 is ejected out of the opaque walled compartment 60 into a visible position in the forward engine or hood compartment 28 and may eventually come to rest on or close to the piston 44 at the center of the foreward bottom wall 38 of the compartment.

A number of turns of the crank handle 92 eventually results in all of the balls being ejected out of the internal, opaque-walled compartment 60 into the forward engine or hood compartment 28. When this occurs, the motor vehicle is "filled up" with fuel or completely refueled with gasoline, ready to roll. The flexible shaft 84 of the gas pump 86 is then disconnected from the socket 83 on the vehicle and the vehicle is ready for play as previously described wherein rolling of the wheels 14 eventually causes the balls 64 in the visible compartment 28 to be transferred to collect in the interior, opaque-walled or secondary compartment 60 simulating the burning of fuel and eventually, the concept of "running out of gas". The vehicle may then be refueled from the gas pump 86 by turning the crank 92 a successive number of revolutions until all of the balls 64 are again ejected out into the visible engine compartment 28. Each time the hammer 66 strikes a ball in the inner compartment 60, the clapper 76 rings the bell 78 and this provides a closer simulation of the actual or real life operation of a conventional gas pump. The stop finger 32a prevents rotation of the shaft 84 in a reverse direction when connected to the socket 83 and also limits the force with which the hammer 66 strikes the lowermost ball 64 in the compartment 60 so that only one ball at a time will be ejected from the compartment for each complete revolution of the crank.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy vehicle comprising:

a body supported by wheel means for rolling movement on a supporting surface;

said body including first and second compartments in communication with each other and containing at least one element movable between said compartments and representing a unit of fuel for powering said vehicle;

one of said compartments including transparent wall means for viewing a fuel representing element present therein and the other of said compartments having opaque walls whereby a fuel representing element present therein is not readily visible from the exterior of said body;

means driven by rotation of said wheel means upon rolling movement of said vehicle for directing a fuel representing element visible in said one compartment toward said other compartment to represent the using of fuel, and means independent of rotation of said wheel means and selectively actuatable for returning a fuel representing element from said other compartment to said one compartment representing the refueling of said vehicle.

2. The toy vehicle of claim 1 wherein said returning means includes first means in said body for propelling said fuel representing elements from said other compartment toward said one compartment and second means detachably connectable with said first means and separated from said body for activating said first means.

3. The toy vehicle of claim 2 wherein said second means includes manually activated means connectable with said first means for activating the same.

4. The toy vehicle of claim 3 wherein said manually activated means includes hand crank means and rotating flexible shaft means driven thereby, said shaft means detachably connectable with said first means for activating the same.

5. The toy vehicle of claim 4 wherein said second means includes a housing shaped to resemble a gas pump and said flexible shaft means resembles a fuel line.

6. The toy vehicle of claim 4 wherein said body includes an opening for receiving an end portion of said flexible shaft means when connected with said first means.

7. The toy vehicle of claim 2 wherein said second compartment includes an elongated tubular structure having an open end in communication with said first compartment and stop means at an opposite end for retaining a plurality of said fuel representing elements in a line.

8. The toy vehicle of claim 7 wherein said first means includes means for striking a fuel representing element adjacent said stop means for propelling an element nearest said open end of said tubular structure to return to said first compartment.

9. The toy vehicle of claim 8 including means for biasing said fuel representing elements toward said stop means.

10. The toy vehicle of claim 8 wherein said striking means includes a swingable hammer movable to strike said element adjacent said stop means successive blows to propel successive elements from said tubular structure into said first compartment.

11. The toy vehicle of claim 10 including sound generating means for generating a sound each time said hammer strikes a blow to represent and simulate an incremental quantity of fuel delivered to said vehicle by a gas pump.

12. The toy vehicle of claim 11 wherein said sound generating means includes a bell and a clapper activated to strike said bell each time said hammer is activated to strike a fuel representing element.

13. The toy vehicle of claim 12 wherein said hammer and clapper are connected to a common shaft mounted for rotation in said body.

14. The toy vehicle of claim 13 wherein said first means includes a rotating member for rotating said common shaft and adapted for detachable interconnection with a flexible rotative shaft of said second means.

* * * * *